US007507355B2

(12) United States Patent
Akutsu et al.

(10) Patent No.: US 7,507,355 B2
(45) Date of Patent: Mar. 24, 2009

(54) SOLVENT COMPOSITION

(75) Inventors: Mitsuo Akutsu, Saitama (JP); Takahiro Otsuka, Saitama (JP)

(73) Assignee: Adeka Corporation, Tokyo (JP)

( * ) Notice: Subject to any disclaimer, the term of this patent is extended or adjusted under 35 U.S.C. 154(b) by 49 days.

(21) Appl. No.: 11/666,731

(22) PCT Filed: Sep. 27, 2005

(86) PCT No.: PCT/JP2005/017713

§ 371 (c)(1),
(2), (4) Date: May 2, 2007

(87) PCT Pub. No.: WO2006/048984

PCT Pub. Date: May 11, 2006

(65) Prior Publication Data

US 2007/0257233 A1 Nov. 8, 2007

(30) Foreign Application Priority Data

Nov. 5, 2004 (JP) ..... 2004-321989

(51) Int. Cl.
*B01F 1/00* (2006.01)

(52) U.S. Cl. ..... 252/364; 510/461; 106/271; 106/311

(58) Field of Classification Search ..... 252/364; 510/461; 106/271, 311
See application file for complete search history.

(56) References Cited

U.S. PATENT DOCUMENTS 5,760,280 A 6/1998 Maeda et al.

FOREIGN PATENT DOCUMENTS

| | | |
|---|---|---|
| JP | 1-132694 | 5/1989 |
| JP | 2-178396 | 7/1990 |
| JP | 3-167298 | 7/1991 |
| JP | 4-68023 | 3/1992 |
| JP | 9-309870 | 12/1997 |

OTHER PUBLICATIONS

English translation of JP 04-68023.*

* cited by examiner

*Primary Examiner*—Douglas McGinty
*Assistant Examiner*—Haidung D Nguyen
(74) *Attorney, Agent, or Firm*—Young & Thompson

(57) ABSTRACT

The solvent composition of the present invention comprises diphenylmethane derivative (a) represented in general formula (I) below, and polyether (b) represented by general formula (II) below, and has high safety, low odor-emission, excellent dissolving power for various organic materials, and high affinity for various substrates.

(I)

(In the formula, n represents 1 or 2, each of x and y independently represents 0, 1, 2, or 3, each of $R_1$ and $R_2$ independently represents a $C_{1-10}$ alkyl group, and when a plurality of $R_1$ or $R_2$ exist, they may be different.)

(II)

(In the formula, m represents 1 to 10, p is 0, 1, 2, or 3, Prop represents a 1,2-propylene group, each of $R_3$ and $R_4$ independently represents a $C_{1-10}$ alkyl group, and when m is 2 or more, methyl groups in 1,2-propylene groups represented by Prop may be randomly located.)

2 Claims, No Drawings

SOLVENT COMPOSITION

TECHNICAL FIELD

The present invention relates to a solvent composition, more specifically to a solvent composition obtained by combination of a specific diphenylmethane derivative and a specific polyether, having high safety, reduced odor, excellent dissolving power for various organic materials, and high affinity to various substrates.

BACKGROUND ART

Solvents play an important role in fields such as paint, adhesive, and printing ink. Solvents are naturally required to have high dissolving power for solutes. In the above fields, solvents also have substantial effects on performances such as wettability for surfaces to be coated and drying property.

As solvents used together with resins commonly used in paint, adhesive, printing ink, and other fields, such as cellulose resin, epoxy resin, acrylic resin, vinyl acetate resin, vinyl chloride resin, alkyd resin, and polyester resin, there has been conventionally used cellosolves which are glycol ethers, particularly cellosolve acetate with appreciation of its excellent performances. However, due to recent very stringent requirement for safety of chemical substances in consideration of problems such as pollution, restriction for use of cellosolve acetate has been tightened because of its toxicity, and the concentration control standard for working environment has been established by the Labor Safety and Hygiene Law.

Therefore, development has been actively pursued for alternative solvents having high dissolving power comparable to cellosolve acetate and no concern about safety. For instance, solvents such as ethyl lactate, propylene glycol monomethyl ether acetate, methoxypropanol, and ethyl β-epoxypropionate are under study as prospective alternative solvents, but they are not fully satisfactory in dissolving power, safety, odor, handleability, or the like. Among them, ethyl lactate, which is approved as a food additive, is considered as most preferable in terms of safety but not quite satisfactory in dissolving power for high-molecular-weight compounds or various additives.

In terms of dissolving power, alkyl β-alkoxypropionates such as methyl β-methoxypropionate and ethyl β-ethoxypropionate are considered as most preferable, but they are not yet satisfactory in dissolving power for high-molecular-weight compounds or various additives, and not satisfactory in volatility after application, either.

In addition to uses as described above, solvents are also used for cleaning cutting oil, process oil, press oil, rust-preventive oil, lubricant oil, and oils used as grease, pitch, or the like; for cleaning solder flux, ink, liquid crystals, etc.; and for other purposes. For such cleaning purpose, there are commonly used solvent compositions mainly composed of halogen-containing solvents such as CFC-113 (1,1,2-trichloro-1,2,2-trifluoroethane), methylchloroform (1,1,1-trichloroethane), and trichloroethylene. Especially, CFC-113 has been widely used because of its nonflammability, low toxicity, and hence high safety, and also because CFC-113 can selectively dissolve various contaminants while not damaging metals, plastics, elastomers, or the like. However, because CFC-113 and methylchloroform destruct ozone layer in the stratosphere, which is a cause of skin cancer, the use thereof has been rapidly restricted. Use of trichloroethylene has been also restricted from safety viewpoint because of problems such as suspicion of carcinogenicity.

Therefore, development is actively conducted for CFC-substitute cleaning agents with excellent cleaning capability comparable to CFC-113 and the like and no concern about ozone layer destruction. For example, Patent Document 1 proposes a cleaning agent comprising 1,2-difluoroethane as a main component. Patent Document 2 proposes a mixture of 1,1-dichloro-2,2,2-trifluoroethane and dimethoxybenzene, while Patent Document 3 proposes a cleaning agent comprising hexafluorobenzene as a main component. However, these solvents are inferior in performance to CFC-113, and the use of these halogen-containing solvents will become wholly restricted in the future because of environmental and safety problems.

Patent Document 1: Japanese Patent Laid-open Publication H1-132694

Patent Document 2: Japanese Patent Laid-open Publication H2-178396

Patent Document 3: Japanese Patent Laid-open Publication H3-167298

DISCLOSURE OF THE INVENTION

Problems to be Solved by the Invention

In consideration of the above-mentioned current situation, an object of the present invention is, therefore, to provide a solvent composition that is highly safe and has low odor-emission, excellent dissolving power for various organic materials, and high affinity for various substrates.

Means for Solving the Problems

As a result of intensive study, the present inventors found that a solvent composition obtained by combination of a specific diphenylmethane derivative and a specific polyether can meet the above object, and thus reached the present invention.

Namely, the present invention provides a solvent composition comprising diphenylmethane derivative (a) represented by general formula (I) below, and polyether (b) represented by general formula (II) below.

[Formula I]

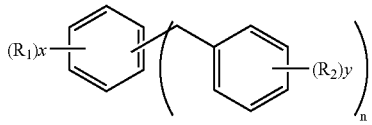

(I)

(In the formula, n represents 1 or 2, each of x and y independently represents 0, 1, 2, or 3, and each of $R^1$ and $R^2$ independently represents a $C_{1-10}$ alkyl group. When a plurality of $R^1$ or $R^2$ exists, they may be different.)

[Formula 2]

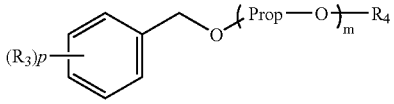

(II)

(In the formula, m represents 1 to 10, p represents 0, 1, 2, or 3, Prop represents a 1,2-propylene group, and each of $R^3$ and $R^4$ independently represents a $C_{1-10}$ alkyl group. When m is 2 or more, methyl groups in 1,2-propylene groups represented by Prop may be randomly located.)

BEST MODE FOR CARRYING OUT THE INVENTION

The solvent composition of the present invention will be detailed below.

In general formula (I), which represents diphenylmethane derivatives serving as component (a), the $C_{1-10}$ alkyl group represented by $R^1$ or $R^2$ includes, for example, methyl, ethyl, propyl, isopropyl, butyl, isobutyl, secondary butyl, tert-butyl, amyl, isoamyl, tert-amyl, hexyl, heptyl, octyl, isooctyl, 2-ethylhexyl, nonyl, isononyl, decyl, isodecyl, and others, among which $R^1$ is preferably a $C_{1-4}$ alkyl group and $R^2$ is also preferably a $C_{1-4}$ alkyl group.

Specific examples of diphenylmethane derivative used in the present invention as component (a) include compounds shown below. These diphenylmethane derivatives may be used alone or in combination of two or more.

[Formula 3]

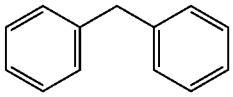

BB

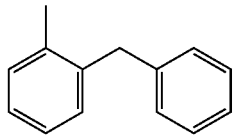

BoT

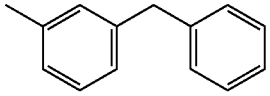

BmT

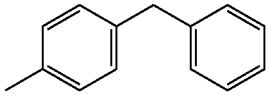

BpT

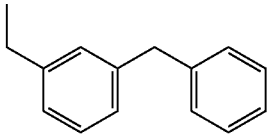

BmEB

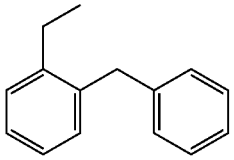

BoEB

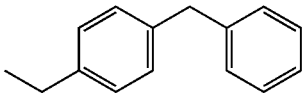

BpEB

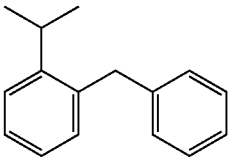

BoCB

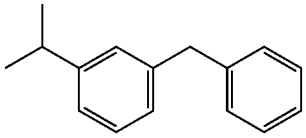

BmCT

-continued

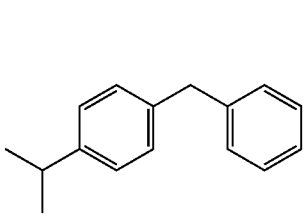

BpCT

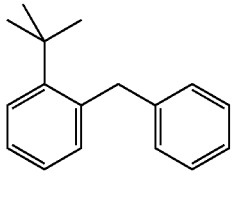

BoTBB

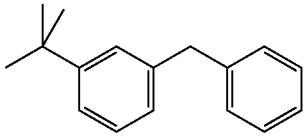

BmTBB

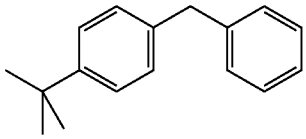

BpTBB

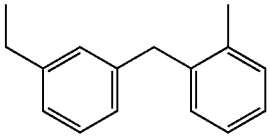

oTmEB

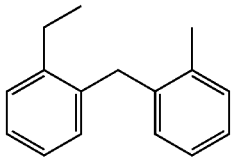

oToEB

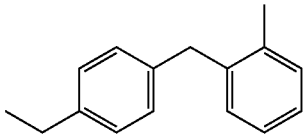

oTpEB

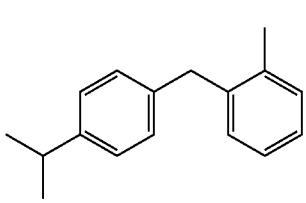

oTpCB

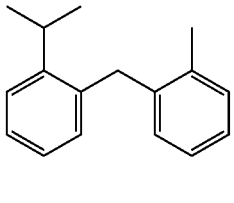

oToCB

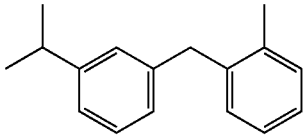

oTmCB

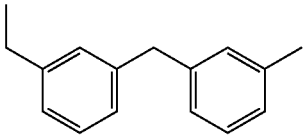

mTmEB

-continued

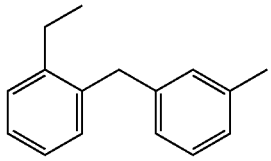

mToEB

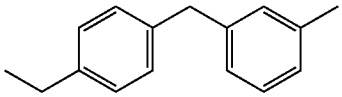

mTpEB

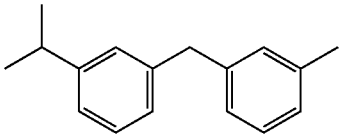

mTmCB

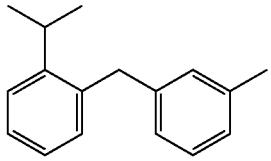

mToCB

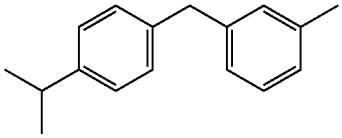

mTpCB

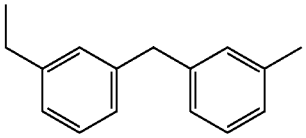

mTmEB

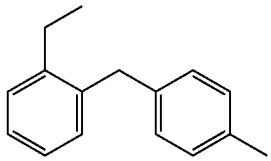

pToEB

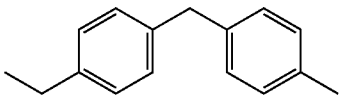

pTpEB

[Formula 4]

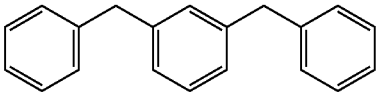

BBB

-continued

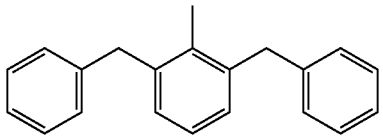

BoTB

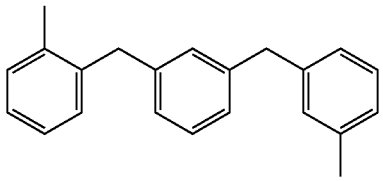

oTBpT

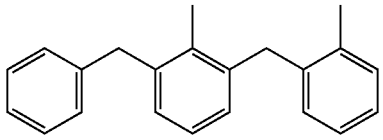

BoToT

Among these diphenylmethane derivatives, benzyltoluenes (BoT, BmT, and BpT in [Formula 3]) are preferred because of particularly excellent dissolving power.

In general formula (II), which represents polyethers serving as component (b), the $C_{1-10}$ alkyl group represented by $R_3$ or $R_4$ includes, for example, methyl, ethyl, propyl, isopropyl, butyl, isobutyl, sec-butyl, tert-butyl, amyl, isoamyl, tert-amyl, hexyl, heptyl, octyl, isooctyl, 2-ethylhexyl, nonyl, isononyl, decyl, isodecyl, and others. Among these, $R_3$ is preferably a $C_{1-4}$ alkyl group, and $R_4$ is also preferably a $C_{1-4}$ alkyl group.

Specific examples of polyether used in the present invention as component (b) include compounds shown below. These polyethers may be used alone or in combination of two or more.

[Formula 5]

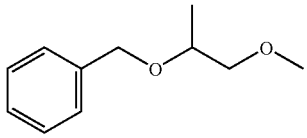

M1PMB

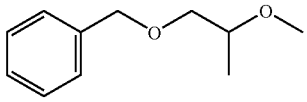

M2PMB

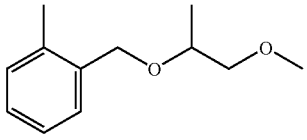

M1PMoT

-continued
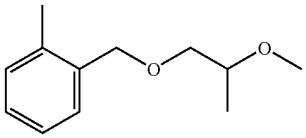
M2PMoT
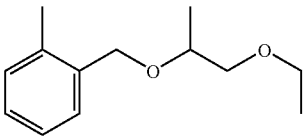
E1PMoT
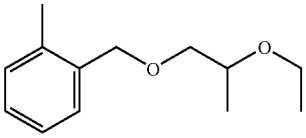
E2PMoT
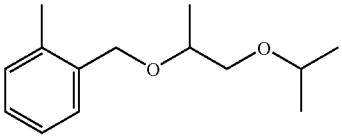
P1PMoT
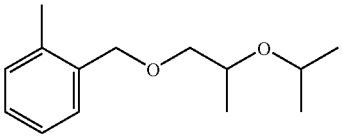
P2PMoT
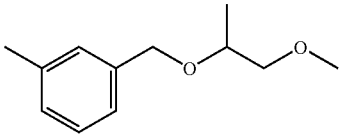
M1PMmT
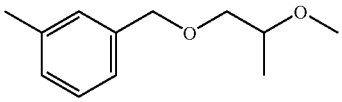
M2PMmT
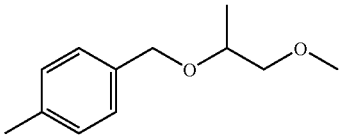
M1PMpT
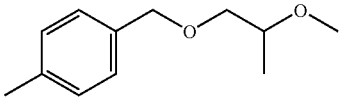
M2PMpT
-continued
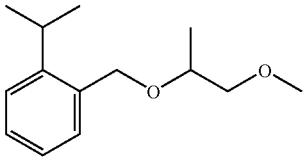
M1PMoCB
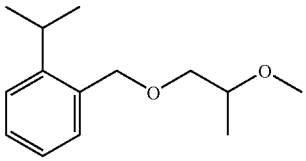
M2PMoCB
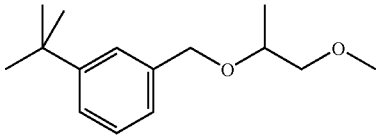
M1PMmTBB
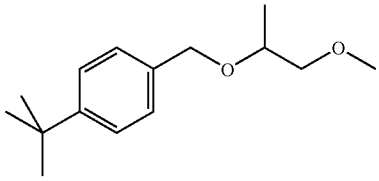
M1PMpTBT
[Formula 6]
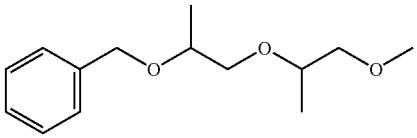
M1P1PMB
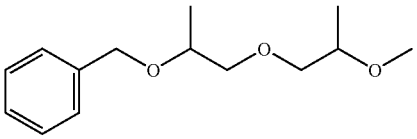
M1P2PMB
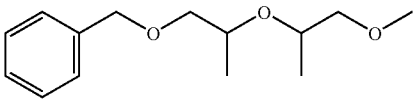
M2P1PMB
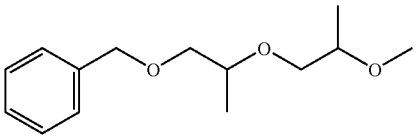
M2P2PMB
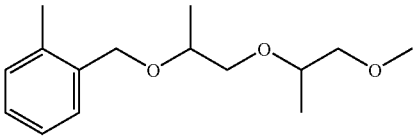
M1P1PMoT -continued

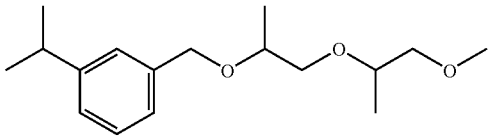

M1P1PMmCB

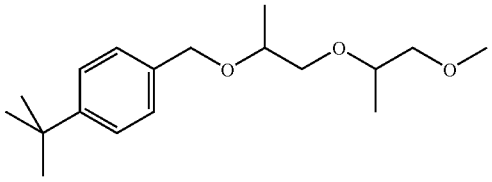

M1P1PMpBTB

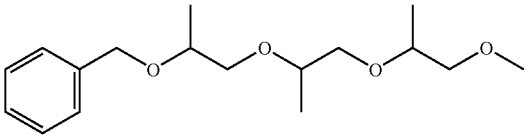

M1P1P1PMB

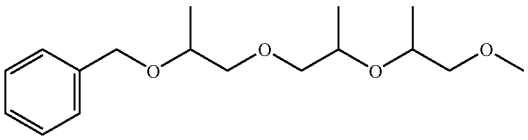

M1P2P1PMB

It is preferred to use, among these polyethers, one or more compounds selected from the group consisting of [(2-methoxy-1,2-propoxy)methyl]benzene (M1PMB and M2PMB shown in [Formula 5]) and [(2-methoxy-1,2-propoxy)methyl]toluene (M1PMoT and M2PMoT shown in [Formula 5]) to further improve wettability for surface to be applied. It is particularly preferred to use [(2-methoxy-1-methylethoxy) methyl]benzene (M1PMB shown in [Formula 5]).

The solvent composition of the present invention comprises a diphenylmethane derivative, component (a), and a polyether, component (b), wherein the content of component (a) is preferably 0.1 to 99.9 mass %, particularly 5 to 95 mass %, and that of component (b) is preferably 0.1 to 99.9 mass %, particularly 5 to 95 mass %. If the content of component (a) is less than 0.1 mass %, the dissolving power tends to be insufficient, while if the content of component (b) is less than 0.1 mass %, the wettability tends to be insufficient.

The solvent composition of the present invention may be used as a mixture with water or another organic solvent.

Examples of other organic solvents include alcohols such as methanol, ethanol, propanol, isopropanol, butanol, 3-methylbutanol, methyl isobutyl carbinol, heptanol, octanol, 2-ethyl-1-hexanol, 3,3,5-trimethyl-1-hexanol, nonanol, cyclohexanol, benzyl alcohol, naphthyl alcohol, and fluoroalcohols; glycols such as ethylene glycol, diethylene glycol, triethylene glycol, polyethylene glycol, propylene glycol, dipropylene glycol, and polypropylene glycol; ether alcohols such as 3-methoxybutanol, 3-methyl-3-methoxybutanol, ethylene glycol monomethyl ether (methyl cellosolve), ethylene glycol monoethyl ether (cellosolve), ethylene glycol monobutyl ether (butyl cellosolve), diethylene glycol monoethyl ether (carbitol), diethylene glycol monobutyl ether (butyl carbitol), and propylene glycol monomethyl ether; ketones such as acetone, methyl ethyl ketone, methyl isobutyl ketone, cyclohexanone, and isophorone; heterocyclic compounds such as pyrrolidone, N-methylpyrrolidone, tetrahydrofuran, oxazole, benzofuran, and dioxane; amides such as dimethylformamide and dimethylacetamide; dimethylsulfoxide; sulfones such as sulfolane; esters such as methyl acetate, ethyl acetate, butyl acetate, amyl acetate, 3-methoxybutyl acetate, 3-methyl-3-methoxybutyl acetate, 2-ethylhexyl acetate, cyclohexyl acetate, benzyl acetate, methyl lactate, ethyl lactate, butyl lactate, methyl 3-methoxypropionate, and ethyl 3-ethoxypropionate; ethers such as dibenzyl ether and anisole; nitro compounds such as nitroethane and nitromethane; nitriles such as acetonitrile; lactones such as γ-butyrolactone; ether esters such as ethylene glycol monomethyl ether acetate, ethylene glycol monoethyl ether acetate, and propylene glycol monomethyl ether acetate; aromatic hydrocarbons such as benzene, toluene, xylene, cumene, cymene, dihexylbenzene, tetramethylbenzene, diethylbenzene, dibutylbenzene, biphenyl, mesitylene and cyclohexylbenzene; fused-ring hydrocarbons such as decalin, alkyldecalin, and tetralin; aliphatic hydrocarbons such as n-hexane, n-heptane, and mineral spirit; alicyclic hydrocarbons such as cyclohexane, alkylcyclohexane, and alkylcyclopentane; and others.

The solvent composition of the present invention can be used for various paint, various adhesive, various ink such as offset ink, planographic ink, letterpress ink, special ink, photogravure ink, ballpoint pen ink, and inkjet printer ink, various coating material, and others.

When the solvent composition of the present invention is used for paint, adhesive, ink, coating material, or the like, various high-molecular-weight substances serving as binder may be used in combination. Such high-molecular-weight substances used as binder include, for example, natural resins and their derivatives such as rosin, shellac, copal, dammar, gilsonite, zein, and cellulose; natural rubbers; various fats and oils; synthetic resins such as acrylic resins (polyacrylate, polymethacrylate, etc.), vinyl acetate resin, vinyl chloride resin, alkyd resin, polyester resin, novolak resin, urea resin, melamine resin, phenol resin, resorcinol resin, epoxy resin, polyurethane, polyvinyl alcohol, xylene resin, ketone resin, chroman-indene resin, petroleum resin, terpene resin, polyamide resin, vinyl chloride-vinyl acetate copolymer resin, polyvinyl butyral, chlorinated polypropylene, styrene resin, polycarbonate, phenoxy resin, and polyacrylonitrile; synthetic rubbers such as chloroprene rubber, nitrile rubber, styrene-butadiene rubber, chlorinated rubber, and cyclized rubber; and others.

When the solvent composition of the present invention is used for paint, adhesive, ink, coating material, or the like, various fillers and/or pigments may be used in combination. The fillers and pigments include, for example, glass fiber, carbon fiber, cellulose, silica sand, cement, kaolin, clay, aluminum hydroxide, bentonite, talc, silica, fine silica powder, titanium dioxide, carbon black, graphite, iron oxide, bitumen, organic pigments, and others.

When the solvent composition of the present invention is used for paint, adhesive, ink, coating material, or the like, various surfactants may be used in combination. As the surfactants, there may be used any of anionic, nonionic, cationic, amphoteric, polymeric, and reactive surfactants.

The anionic surfactants include, for example, alkyl sulfates such as sodium dodecyl sulfate, potassium dodecyl sulfate, and ammonium dodecyl sulfate; sodium dodecylpoly(oxyethylene) sulfate; sodium sulforicinoate; alkylsulfonates such as alkali metal salt of sulfonated paraffin and ammonium salt of sulfonated paraffin; fatty acid salts such as sodium laurate, triethanolamine oleate, and triethanolamine abietate; alkylarylsulfonates such as sodium benzenesulfonate and alkali metal salt of alkylphenoxyethanesulfonic acid; higher-alkyl-substituted naphthalenesulfonic acid; naphthalenesulfonic acid-formalin condensate; dialkyl sulfosuccinate; poly(oxyethylene)alkyl sulfate; poly(oxyethylene)alkylaryl sulfate; and others.

The nonionic surfactants include, for example, polyoxyethylene-polypropylene copolymer, ethylene oxide-adduct of lauryl ether, ethylene oxide-adduct of cetyl ether, ethylene oxide-adduct of stearyl ether, ethylene oxide-adduct of oleyl ether, ethylene oxide-adduct of octyl phenyl ether, ethylene oxide-adduct of nonyl phenyl ether, ethylene oxide-adduct of bisphenol-A, sorbitan monolaurate, sorbitan monopalmitate, sorbitan monostearate, sorbitan tristearate, sorbitan monooleate, sorbitan trioleate, sorbitan sesquioleate, sorbitan distearate, ethylene oxide-adduct of sorbitan monolaurate, ethylene oxide-adduct of sorbitan monopalmitate, ethylene oxide-adduct of sorbitan monostearate, ethylene oxide-adduct of sorbitan tristearate, ethylene oxide-adduct of sorbitan monooleate, ethylene oxide-adduct of sorbitan trioleate, polyoxyethylenesorbit tetraoleate, glycerol monostearate, polyethylene glycol monolaurate, polyethylene glycol monostearate, polyethylene glycol distearate, polyethylene glycol monooleate, polyethylenealkylamine, ethylene oxide-adduct of caster oil, ethylene oxide-adduct of hardened caster oil, condensate of these with a polyisocyanate, and others.

The cationic surfactants include, for example, primary to tertiary amine salts, pyridinium salts, quaternary ammonium salts, and others.

The amphoteric surfactants include betaine-type, sulfate ester-type, and sulfonic acid-type amphoteric surfactants and others.

The polymeric surfactants include, for example, polyvinyl alcohol; sodium poly(meth)acrylate, potassium poly(meth) acrylate, ammonium poly(meth)acrylate, polyhydroxyethyl (meth)acrylate, polyhydroxypropyl (meth)acrylate; copolymers of two or more kinds of monomers constituting these polymers, or copolymers of such monomer with another monomer; and others. Furthermore, compounds called phase-transfer catalysts, such as crown ethers, are also useful as reagents with surface activity.

As the reactive surfactants, any of nonionic, anionic, and cationic surfactants may be used as long as it contains an unsaturated bond, which is copolymerizable with an unsaturated monomer, in the molecule.

When the solvent composition of the present invention is used for paint, adhesive, ink, coating material, or the like, plasticizer may be used in combination. Such plasticizers include dibutyl phthalate, dioctyl phthalate, dioctyl adipate, dioctyl azelate, triethyl citrate, tributyl acetylcitrate, dibutyl sebacate, dioctyl sebacate, epoxidized animal oil, epoxidized vegetable oil, epoxidized fatty acid ester, polyester-type plasticizer, chloroparaffin, and others.

When the solvent composition of the present invention is used for paint, adhesive, ink, coating material, or the like, there may be added, as needed, rust-preventive agent, anticorrosive agent, antifoaming agent, stabilizer, antioxidant, thickener, and others.

Paint, adhesive, ink, coating material, and the like obtained by using the solvent composition of the present invention can be applied to various substrates. Such substrate includes, for example, polymers such as polyethersulfone, polyethylene terephthalate, polycarbonate, polyether ether ketone, polyvinyl fluoride, polyacrylate, polymethyl methacrylate, polyamide, polypropylene, polyethylene, cycloolefin polymer, amorphous polyolefin, and fluororesin; inorganic materials such as glass and ceramics; and others.

The solvent composition of the present invention can also be utilized as solvent to dissolve various organic compounds in producing those electronic devices which are developed as application of conventional printing technologies, such as optical recording materials, organic EL elements and field-effect transistors.

The optical recording material comprises a dye layer containing an optical memory dye, a PC substrate, a reflective film, and others. The optical memory dye includes, for example, cyanine dyes, phthalocyanine dyes, naphthalocyanine dyes, naphtholactam dyes, picoline dyes, azo dyes, phenothiazine dyes, pyrylium dyes, thiopyrylium dyes, squarylium dyes, azulenium dyes, indophenol dyes, indoaniline dyes, triphenylmethane dyes, quinone dyes, anthraquinone dyes, aminium dyes, diimmonium dyes, metal complex dyes, and others.

The organic EL element comprises a luminescent layer containing a luminescent material, a substrate, an ITO anode, a hole-injection layer, a hole-conductive layer, an electron-transport layer, an Al cathode, and others. The luminescent material includes, for example, fluorene derivatives, p-phenylenevinylene derivatives, polyphenylene derivatives, polyvinylcarbazole, polythiophene derivatives, perylene dyes, coumarin dyes, rhodamine dyes, pyran dyes, anthrone dyes, porphyrin dyes, quinacridone dyes, N,N'-dialkylquinacridone dyes, naphthalimide dyes, N,N'-diarylpyrrolopyrrole dyes, and others.

The field-effect transistor comprises a semi-conductor layer containing an organic semi-conductor material, an insulating layer, a gate electrode, a source electrode, a drain electrode, and others. The organic semi-conductor material includes, for example, perylene pigments such as N,N'-dialkylperylene-3,4,9-10-tetracarboxylic diimides, naphthalene-1,4,5,8-tetracarboxylic diimides, various metallophthalocyanines, nitrofluorenones, substituted fluorene-malononitrile adduct, halogenated anthoanthrones, tri(8-hydroxyquinoline)aluminum, oligomers and polymers containing these, and others.

The solvent composition of the present invention can be also used as a cleaning agent for cleaning rosin-type solder flux used for printed-circuit substrates, liquid crystal cells, and the like; or for removing contaminant mainly composed of organic substances such as oils present on solid surfaces of electronic devices or precision machines, for example, metallic parts of electronic devices such as precision parts, their assembling jigs, etc. or etching-processed parts (printed circuits, integrated circuits, shadow masks, etc.).

When the solvent composition of the present invention is used as a cleaning agent, a surfactant may be used in combination. As the surfactant, any of anionic, cationic, amphoteric, and nonionic surfactants may be used, but nonionic surfactant is preferred in terms of influence on surfaces to be cleaned.

When the solvent composition of the present invention is used as a cleaning agent, there may be added, if necessary, organic acids such as citric acid, tartaric acid, and phthalic acid; alkanolamines such as monoethanolamine and diethanolamine; rust preventives, anticorrosive agents, antifoaming agents, stabilizers, antioxidants, and others.

As for the cleaning method, various methods can be applied such as soaking, supersonic cleaning, shaking, spraying, steam cleaning, hand cleaning, and water-substitution drying.

EXAMPLES

The present invention will be illustrated with Examples and the like hereinafter. However, the present invention is not limited by these Examples.

Examples 1 to 5

Solvent compositions S1 to S5 were prepared in the component ratios shown in Table 1.

TABLE 1

| Solvent composition | | Examples 1 S1 | 2 S2 | 3 S3 | 4 S4 | 5 S5 |
|---|---|---|---|---|---|---|
| Component ratio (Parts by mass) | BT*1 | 90 | 85 | 80 | | |
| | BoT | | | | 85 | |
| | BpT | | | | | 85 |
| | M1PMB | 10 | 15 | 20 | 15 | 15 |
| Appearance | | Colorless transparent | Colorless transparent | Colorless transparent | Colorless transparent | Colorless transparent |

*1BoT/BpT mixture (mass ratio 1/1)

Comparative Example 1 to 5

Solvent compositions HS1 to HS5 were prepared in the component ratios shown in Table 2.

TABLE 2

| Solvent composition | | Comparative Examples 1 HS1 | 2 HS2 | 3 HS3 | 4 HS4 | 5 HS5 |
|---|---|---|---|---|---|---|
| Component ratio (Parts by mass) | BT | | | | 85 | |
| | Methyl-naphthalene | 90 | 85 | 80 | | 85 |
| | M1PMB | | | | | 15 |
| | Ethyl cellosolve | 10 | 15 | 20 | 15 | |
| Appearance | | Colorless transparent | Colorless transparent | Colorless transparent | Colorless transparent | Colorless transparent |

Evaluation Examples

The following evaluations and measurements were made for the solvent compositions obtained in Examples and Comparative Examples above and other solvents (BT and M1PMB).

(Evaluation of Odor)

Odor was rated in sensory test by ten examinees on 3-level scale, Good: virtually no odor, Intermediate: odor, and Poor: strong odor.

(Evaluation of Dissolving Power)

To each solvent composition was added 5 mass % of a solute (organic compound) shown in Table 3, and the mixture was stirred at 30° C. for 1 hour. Dissolution status was observed to rate the dissolving power on 3-level scale, Good: completely dissolved, Intermediate: with a slight amount of insoluble matter, and Poor: completely or virtually insoluble.

(Measurement of Contact Angle)

On a glass plate (manufactured by Matsunami Glass Ind. Ltd; MICRO SLIDE GLASS S1226) washed with neutral detergent, rinsed with ultrapure water, and dried, 10 μL of the solvent was dropped, and the contact angle was measured using CONTACT-ANGLE METER CA-D manufactured by Kyowa Interface Science Co., Ltd. At the measurement, the ambient temperature was 22 to 25° C. and humidity was 50% to 70%. The contact angle was measured six times and the average value excluding the maximum and the minimum values was reported.

When the contact angle exceeds 20°, it is difficult to apply the solvent, while when it is 15° or lower, the solvent is particularly well applied.

The results of evaluation and measurement are shown in Table 3.

TABLE 3

| Solvent | Odor | Dissolving power | | | | | | Contact angle |
|---|---|---|---|---|---|---|---|---|
| | | Solute 1*2 | Solute 2*3 | Solute 3*4 | Solute 4*5 | Solute 5*6 | Solute 6*7 | |
| S1 (Example 1) | Good | Good | Good | Good | Good | Good | Good | 15 |
| S2 (Example 2) | Good | Good | Good | Good | Good | Good | Good | 14 |
| S3 (Example 3) | Good | Good | Good | Good | Good | Good | Good | 13 |
| S4 (Example 4) | Good | Good | Good | Good | Good | Good | Good | 14 |
| S5 (Example 5) | Good | Good | Good | Good | Good | Good | Good | 14 |
| HS1 (Comparative Example 1) | Poor | Good | Good | Good | Good | Good | Good | 18 |
| HS2 (Comparative Example 2) | Poor | Good | Good | Good | Good | Good | Good | 17 |
| HS3 (Comparative Example 3) | Poor | Good | Good | Good | Good | Good | Good | 16 |
| HS4 (Comparative Example 4) | Intermediate | Good | Good | Good | Good | Good | Good | 16 |
| HS5 (Comparative Example 5) | Poor | Good | Good | Good | Good | Good | Good | 16 |
| BT | Good | Good | Good | Good | Good | Good | Intermediate | 21 |
| M1PMB | Good | Intermediate | Intermediate | Intermediate | Intermediate | Intermediate | Good | 11 |

*2Solute 1 = ER-1002 (manufactured by Mitsubishi Rayon Co., Ltd.; Polyester)
*3Solute 2 = QPx2B (manufactured by Denki Kagaku Kogyo K.K.; Polystyrene)
*4Solute 3 = MS-300 (manufactured by Nippon Steel Chemical Co., Ltd.; MMA-styrene copolymer)
*5Solute 4 = Acrylic A-405 (manufactured by DaiNippon Ink and Chemicals Inc.; Acrylic resin)
*6Solute 5 = PKH-H (manufactured by UCC; Phenoxy resin)
*7Solute 6 = P1800NT11 (manufactured by AMOCO; Polysulfone)

As is clearly seen in Table 3, the solvent compositions obtained by combination of a naphthalene-type solvent and an ethereal solvent have excellent dissolving power for various organic compounds used as binders, but their odor is strong, and large contact angle indicates inferior wettability for the substrate (Comparable Examples 1 to 3). A combination of a naphthalene-type solvent and the specific polyether used in the present invention also shows similar results (Comparable Example 5). Furthermore, a combination of the specific diphenylmethane derivative used in the present invention and an ethereal solvent such as ethyl cellosolve, which is different from the specific polyether used in the present invention, has excellent dissolving power, but has odor and problems in safety (Comparable Example 4). If the specific diphenylmethane derivative used in the present invention (BT) is used alone, the wettability is insufficient while if the specific polyether used in the present invention (M1PMB) is used alone, the dissolving power is insufficient.

In contrast, the solvent compositions of the present invention comprising the specific diphenylmethane derivative and the specific polyether have low odor-emission, excellent dissolving power for various organic compounds, and also excellent wettability for the substrate.

INDUSTRIAL APPLICABILITY

The solvent composition of the present invention is highly safe, virtually odorless, and excellent in dissolving power for various organic materials, has high affinity for various substrates, and can be suitably used for various applications such as paint, adhesive, coating materials, and cleaning agents.

The invention claimed is:

1. A solvent composition comprising:

(i) a diphenylmethane derivative represented by general formula (I)

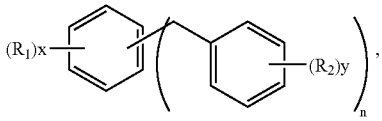

(I)

wherein n represents 1 or 2, each of x and y independently represents 0, 1, 2, or 3, each of $R_1$ and $R_2$ independently represents an alkyl group having 1 to 10 carbon atoms, and when a plurality of $R_1$ or $R_2$ exists, they may be different; and (ii)[(2-methoxy-1-methylethoxy)methyl]benzene.

2. A solvent composition comprising benzyltoluene and [(2-methoxy-1-methylethoxy)methyl]benzene.

* * * * *